US006076994A

United States Patent [19]

Brockway et al.

[11] Patent Number: 6,076,994

[45] Date of Patent: Jun. 20, 2000

[54] METHOD AND APPARATUS FOR PROVIDING WATER FROM A BODY OF WATER

[75] Inventors: David C. Brockway, Dublin, Ohio; William A. Hawkins, Euless; William T. Slingerland, Carrollton, both of Tex.; Lee R. Dunbar, Manitou Beach, Mich.; Jonathan D. Williams, Irving, Tex.

[73] Assignee: Rosewood Equipment Company, Plano, Tex.

[21] Appl. No.: 09/249,365

[22] Filed: Feb. 11, 1999

[51] Int. Cl.[7] ..... E01F 5/00; E03F 3/00; B01D 33/00

[52] U.S. Cl. ..... 405/127; 405/52; 210/122; 210/170; 210/242.1

[58] Field of Search ..... 405/36, 37, 52, 405/127; 210/122, 170, 242.1

[56] References Cited

U.S. PATENT DOCUMENTS

| | | | |
|---|---|---|---|
| 719,240 | 1/1903 | Lydon | 405/36 |
| 837,566 | 12/1906 | Heinz . | |
| 921,513 | 5/1909 | Crawford | 405/52 |
| 1,591,421 | 7/1926 | Gilbert | 405/127 |
| 2,361,231 | 10/1944 | Nebolsine | 405/127 |
| 2,597,728 | 5/1952 | Hink | 210/97 |
| 2,663,425 | 12/1953 | Haselwood | 210/97 |
| 2,933,051 | 4/1960 | Toulmin, Jr. | 103/252 |
| 3,120,491 | 2/1964 | Kincaid | 210/242 |
| 3,782,552 | 1/1974 | Wendell | 210/242.1 |
| 4,092,036 | 5/1978 | Sato et al. | 285/337 |
| 4,168,091 | 9/1979 | Boomgarden et al. | 285/419 |
| 4,179,379 | 12/1979 | Mitchell | 210/242.1 |
| 4,647,374 | 3/1987 | Ziaylek et al. | 210/242.1 |
| 5,052,855 | 10/1991 | Chapman et al. | 405/127 |
| 5,113,889 | 5/1992 | McGuire, Jr. | 405/127 |

FOREIGN PATENT DOCUMENTS

| | | |
|---|---|---|
| 42903 | 3/1980 | Japan . |
| 16721 | 2/1981 | Japan . |
| 233010 | 12/1984 | Japan . |

*Primary Examiner*—Eileen Dunn Lillis
*Assistant Examiner*—Gary S. Hartmann
*Attorney, Agent, or Firm*—Standley & Gilcrest LLP

[57] ABSTRACT

A method and apparatus for providing water from a lake, pond, or other body of water, relatively silt and sediment free. A water inlet is positioned off the bottom of the body of water and is adjustably supported from the bottom of the body of water. The inlet is maintained above the silt and sediment layer at the bottom of the body of water and below the surface layer of the body of water.

14 Claims, 3 Drawing Sheets

METHOD AND APPARATUS FOR PROVIDING WATER FROM A BODY OF WATER

BACKGROUND AND SUMMARY OF THE INVENTION

The present invention relates generally to removal of water from a body of water, and more specifically, to maintaining a water inlet which is above the bottom of the body of water and below the surface of the body of water.

Water is frequently pumped or otherwise obtained from bodies of water for several purposes, all of which may benefit from the following invention. For example, water is pumped from lakes or ponds for irrigation purposes. One common use of irrigation is for maintaining golf course grass.

Continuing with golf course irrigation as an example, turf grasses are expensive and can be difficult to maintain. Lakes and ponds on golf courses usually have earthen bottoms and tend to accumulate silt and sediment. In addition, debris such as leaves, twigs, and even litter may accumulate on the surface of such ponds and lakes. If silt, sediment, or debris are present in the irrigation water which is applied to the turf grass, the turf grass may be damaged.

A water inlet for an irrigation system should be free of silt, sediment, and other debris to function properly and have a long, relatively problem free life. Furthermore, if the water obtained from the ponds and lakes is relatively free of such matter, the irrigation water provided to the golf course will not deposit such matter on the turf grass during the irrigation process.

Golf course irrigation systems may include a sump from which the irrigation water is obtained. The sump may be located adjacent to a body of water. A flume or water pipe may extend from the body of water into the sump. A pump may be located in the sump and connected to the water pipe. A water inlet is at the other end of the pipe which is disposed in the water body. If the water inlet is not kept free of debris, silt, and other matter, the pump system will eventually malfunction.

Many other problems associated with pumping water from a body of water are well known to those of ordinary skill in the art of water pumping. The present invention is intended to solve one or more of these problems. The present invention supports a water inlet device above the silt and sediment layer of a body of water and below the surface of the body of water. The present invention supports the water inlet device without the use of a surface float commonly used in other known systems. A preferred embodiment of the system includes a relatively rigid water pipe extending from the sump into the water body. A swivel joint is preferably connected to the end of the pipe which is in the body of water. A water inlet device may be connected to the swivel joint. The water inlet device is raised above the bottom of the body of water.

The system may further include a structure such as an anchor which is secured to the bottom of the water body and connected to the water pipe or to a component that is connected to the water pipe, e.g., an elbow pipe joint or the water inlet device. The anchor preferably helps to maintain the water inlet device raised above the bottom of the water body. The system may also include one or more floats attached to the water inlet device to provide sufficient buoyancy to raise the water inlet device off the bottom of the water body. In addition, the system may include a mechanical or electromechanical subsystem for raising or lowering the water inlet device such that the water inlet device remains above the bottom of the water body.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

The present invention is directed to a system for maintaining a water inlet device above the bottom of a body of water. The present invention preferably reduces the possibility that the water inlet device will be clogged with soil, sediment, or types of debris. The present invention also preferably reduces the possibility that the water inlet device will admit soil, sediment, or other types of debris into the pumping system.

Figure 1:
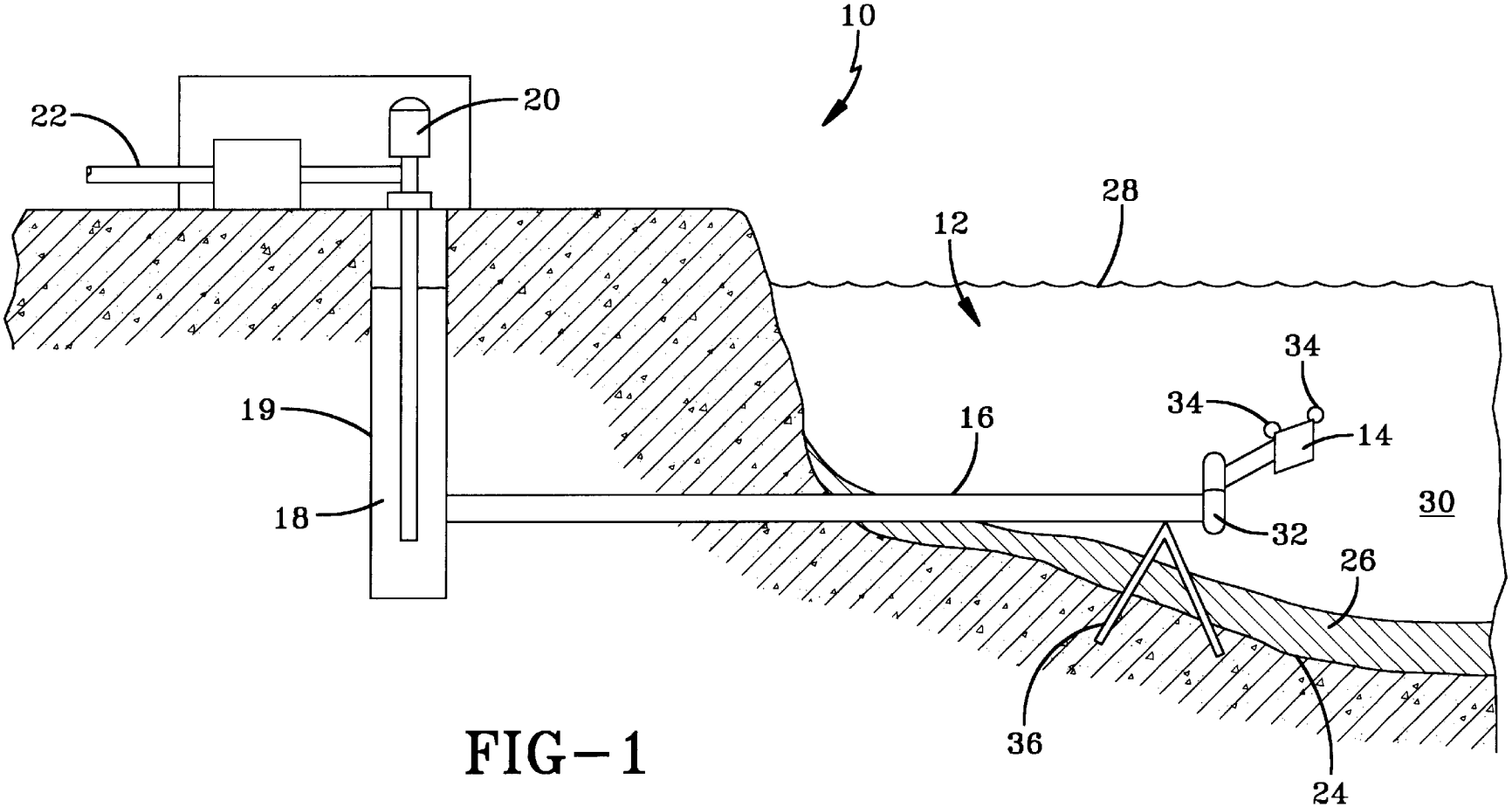
FIG. 1 is a side elevation/cross section view of a preferred embodiment of the present invention.

Referring now to FIG. 1, there is shown a preferred embodiment of a water collection system of the present invention. In this example, an irrigation system is shown at 10 in which water is collected from a pond 12 through a water inlet device 14. The water inlet device 14 preferably has screened or mesh portions through which water may enter the water inlet device 14. In addition, the screened or mesh portions preferably limit the amount of silt, sediment, and 20 debris that enters the water inlet device 14. The size of the water inlet device 14 may vary according to the demand of the pumping station.

The water passes from the water inlet device 14 through a pipe 16 to a sump 18. A well casing 19 in the sump 18 may be connected to a pump 20 which is adapted to draw water out of the sump 18 and into a distribution pipe 22. From the distribution pipe 22, the water may be pumped to its intended site. For example, the water may be pumped to a golf course for irrigating the turf grass.

At the bottom 24 of the pond 12 is a silt and sediment zone 26. This zone 26 contains matter that can clog a water inlet device 14. Leaves and other debris may float on the surface 28 of the pond 12. Such debris could also clog a water inlet device 14. Therefore, the present invention is designed to maintain the water inlet device 14 above the bottom 24 of the pond 12, and more particularly, above the zone 26, yet below the surface 28. In this mid-zone 30 of the pond 12, the water is less likely to have debris or other matter that may clog or otherwise obstruct the flow of water through the water inlet device 14.

The water inlet device 14 may be suspended in the mid-zone 30 by one or more methods. In a preferred embodiment as shown in FIG. 1, the water inlet device 14 is attached to a swivel joint 32. A swivel joint 32 may be any type of joint that enables the water inlet device 14 to rotate relative to the pipe 16. One example of a swivel joint 32 is an N-12 elbow pipe joint which is available from Advanced Drainage Systems, Inc. in Ennis, Tex. The water inlet device 14 may further have floats 34 attached thereto which tend to cause the water inlet device 14 to rise a predetermined distance above the pipe 16 and thereby stay above the zone 26. The floats 34 are preferably buoyant. One example of a float 34 is an air-filled, polyethylene cylinder/pipe which is available from Driscopipe in Richardson, Tex.

Figure 3:
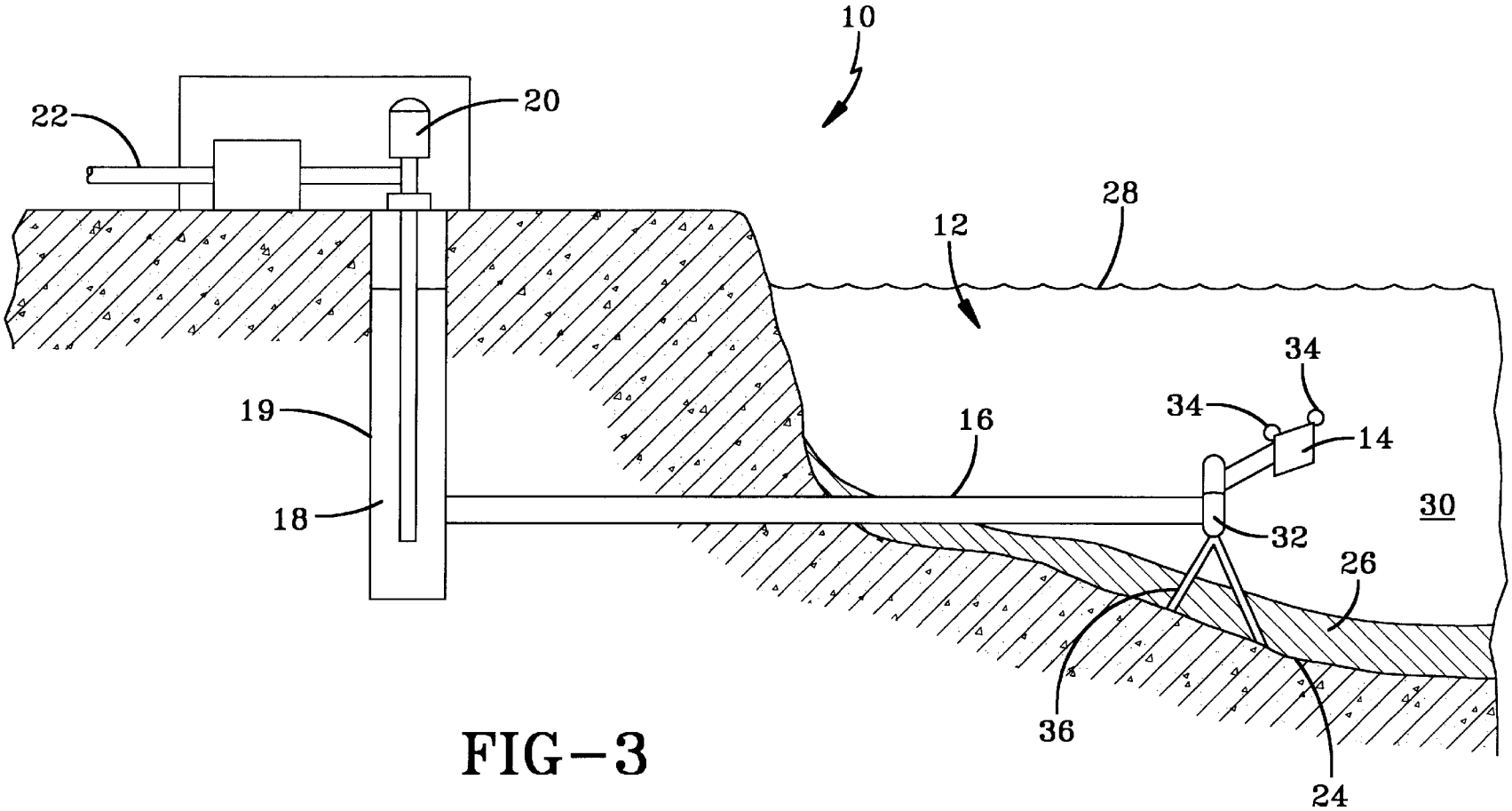

The system 10 may further include a structure 36, e.g., an anchor, that has a portion which is secured to, or otherwise resting against, the bottom 24 of the pond 12. An opposing portion of the structure 36 is preferably connected to the pipe 16. It should also be recognized that the opposing portion of the structure 36 may be connected to a component that is connected to the pipe 16, e.g., the water inlet device or the swivel joint. In the example of FIG. 1, the water inlet device 14 is anchored a predetermined distance above the bottom 24 of the pond 12 by securing the pipe 16 to the structure 36 that is embedded into the bottom 24. On the other hand, FIG. 3 shows an example of the structure 36 connected to the swivel joint 32 and resting against the bottom 24. The structure 36 is of sufficient strength and height to support the pipe 16 and water inlet device 14 above the zone 26.

Figure 2:
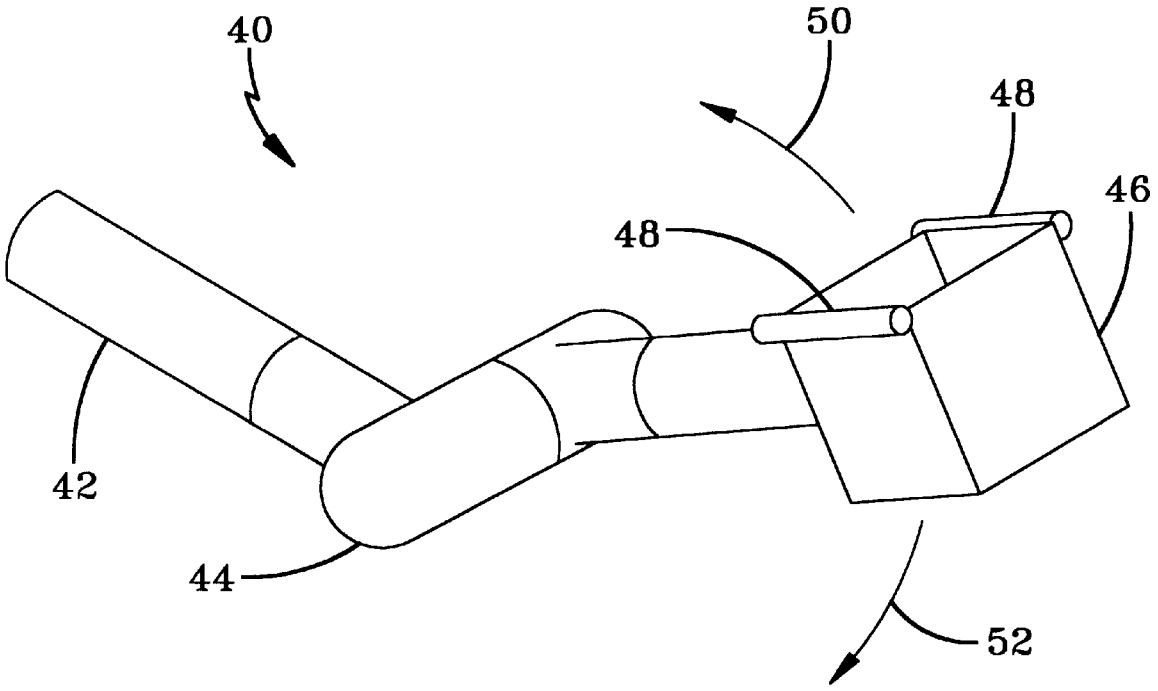
FIG. 2 is a perspective view of another preferred embodiment of the present invention and FIG. 3 is a side elevation/cross section view of yet another preferred embodiment of the present invention.

FIG. 2 illustrates another embodiment of a system of the present invention. In this embodiment, the system 40 is comprised of a pipe 42, a swivel joint 44, and a water inlet device 46. The water inlet device 46 includes floats 48. The swivel joint 44 enables the water inlet device 46 to rotate within a predetermined range in the directions indicated by arrows 50, 52. It is preferred that the swivel joint 44 is maintained a predetermined distance above the silt and sediment zone of the body of water so that the water inlet device 46 does not make contact with the silt and sediment zone when it rotates in the direction indicated by arrow 52.

In yet another embodiment, the water inlet device may be secured about a swivel joint and further coupled to a mechanical or electromechanical subsystem for raising and lowering the inlet device such that it remains above the silt and sediment zone of the body of water and below the surface of the body of water. For example, a pulley system may be used to raise and lower the water inlet device.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A method for providing water from a source of water, said method comprising:

providing a water inlet device to collect said water;

providing a pipe adapted to deliver said water to a predetermined destination;

connecting said water inlet device to said pipe such that a water inlet end of said water inlet device is adapted to move relative to said pipe;

attaching at least one float to said water inlet device, said at least one float adapted to cause said water inlet device to rise relative to the bottom of said source of water;

maintaining said water inlet device above a silt and sediment zone at the bottom of said source of water independent of any surface float; and maintaining said water inlet device below the surface of said source of water independent of any surface float.

2. The method of claim 1 further comprising anchoring an end portion of said pipe to the bottom of said source of water such that said end portion is substantially maintained a fixed distance above the bottom of said source of water.

3. An apparatus for providing water from a source of water, said apparatus comprising:

a water inlet device adapted to receive water from said source of water;

a pipe extending into said source of water, said pipe connected to said water inlet device, said pipe adapted to transfer said water from said water inlet device to a predetermined destination, said water inlet device adapted to move relative to said pipe; and at least one float attached to said water inlet device, said at least one float adapted to cause said water inlet device to rise relative to the bottom of said source of water;

wherein said water inlet device is maintained above a silt and sediment zone at the bottom of said source of water independent of any surface float; and wherein said water inlet device is maintained below the surface of said source of water independent of any surface float.

4. The apparatus of claim 3 wherein said water inlet device has at least one screened or mesh portion through which said water may enter said water inlet device, said at least one screened or mesh portion adapted to limit the amount of silt, sediment, and debris that enters said water inlet device.

5. The apparatus of claim 3 further comprising a structure connected between an end portion of said pipe and the bottom of said source of water, said structure adapted to substantially maintain said end portion of said pipe a fixed distance above the bottom of said source of water.

6. The apparatus of claim 5 wherein said structure is embedded in the bottom of said source of water.

7. The apparatus of claim 5 wherein said structure is resting against the bottom of said source of water.

8. The apparatus of claim 3 wherein said water inlet device is connected to said pipe by a swivel joint which enables said water inlet device to move relative to said pipe and further comprising a structure connected between said swivel joint and the bottom of said source of water, said structure adapted to substantially maintain said swivel joint a fixed distance above the bottom of said source of water.

9. The apparatus of claim 8 wherein said structure is embedded in the bottom of said source of water.

10. The apparatus of claim 8 wherein said structure is resting against the bottom of said source of Water.

11. The apparatus of claim 3 wherein said predetermined destination is a sump.

12. An apparatus for providing water from a source of water, said apparatus comprising:

a water inlet device adapted to receive water from said source of water;

a pipe extending into said source of water, said pipe connected to said water inlet device, said pipe adapted to transfer said water from said water inlet device to a predetermined destination;

a swivel joint connecting said water inlet device to said pipe, said swivel joint adapted to enable said water inlet device to rotate relative to said pipe;

a structure connected between said swivel joint and the bottom of said source of water, said structure adapted to substantially maintain said swivel joint a fixed distance above the bottom of said source of water; and at least one float attached to said water inlet device, said at least one float adapted to cause said water inlet device to rise relative to the bottom of said source of water;

wherein said water inlet device is maintained above a silt and sediment zone at the bottom of said source of water; and wherein said water inlet device is maintained below the surface of said source of water.

13. The apparatus of claim 12 wherein said structure is embedded in the bottom of said source of water.

14. The apparatus of claim 12 wherein said structure is resting against the bottom of said source of water.

* * * * *

UNITED STATES PATENT AND TRADEMARK OFFICE

CERTIFICATE OF CORRECTION

PATENT NO. : 6,076,994

DATED : June 20, 2000

INVENTOR(S) : David C. Brockway et al.

It is certified that error appears in the above-identified patent and that said Letters Patent is hereby corrected as shown below:

column 2, line 44, please delete the number "20".

Signed and Sealed this

First Day of May, 2001

Nicholas P. Godici

*Attest:*

NICHOLAS P. GODICI

*Attesting Officer*

*Acting Director of the United States Patent and Trademark Office*